US009674600B2

(12) United States Patent
Yuen

(10) Patent No.: US 9,674,600 B2
(45) Date of Patent: Jun. 6, 2017

(54) EARPHONES WITH AIR RELEASE VALVES

(71) Applicant: ACOUSTIC INNOVATION (HUIZHOU) CO., LTD., Guangdong (CN)

(72) Inventor: Chee Kit Yuen, Guangdong (CN)

(73) Assignee: ACOUSTIC INNOVATION (HUIZHOU) CO., LTD., Guangdong (CN)

( * ) Notice: Subject to any disclaimer, the term of this patent is extended or adjusted under 35 U.S.C. 154(b) by 0 days.

(21) Appl. No.: 14/913,134

(22) PCT Filed: Aug. 21, 2013

(86) PCT No.: PCT/CN2013/081924
§ 371 (c)(1),
(2) Date: Feb. 19, 2016

(87) PCT Pub. No.: WO2015/024207
PCT Pub. Date: Feb. 26, 2015

(65) Prior Publication Data

US 2016/0212524 A1 Jul. 21, 2016

(51) Int. Cl.
*H04R 25/00* (2006.01)
*H04R 1/28* (2006.01)
(Continued)

(52) U.S. Cl.
CPC ..... *H04R 1/2823* (2013.01); *H04R 1/021* (2013.01); *H04R 1/025* (2013.01); *H04R 1/1066* (2013.01); *H04R 2307/025* (2013.01)

(58) Field of Classification Search
CPC .. H04R 1/2823; H04R 1/2803; H04R 1/1008; H04R 1/021; H04R 1/025; H04R 1/1066
(Continued)

(56) References Cited

U.S. PATENT DOCUMENTS

| | | | | |
|---|---|---|---|---|
| 7,401,680 | B2 | 7/2008 | Kurth | |
| 2003/0215108 | A1 | 11/2003 | Shelley et al. | |
| 2009/0226023 | A1* | 9/2009 | Akino | H04R 1/1008 381/374 |

FOREIGN PATENT DOCUMENTS

| | | | |
|---|---|---|---|
| CN | 202759569 | U | 2/2013 |
| CN | 203387652 | U | 1/2014 |
| JP | 2004274326 | A | 9/2004 |

OTHER PUBLICATIONS

International Search Report for PCT/CN2013/081924 Mailed Aug. 15, 2014; English Translation submitted herewith (7 Pages).

* cited by examiner

*Primary Examiner* — Sunita Joshi
(74) *Attorney, Agent, or Firm* — Fitch, Even, Tabin & Flannery, LLP

(57) ABSTRACT

The utility model relates to an earphone with air release valve, comprising a shell, the shell is provided with an earphone rear cavity for accommodating a sounding unit, the sounding unit is placed in the earphone rear cavity and fixedly connected with the shell, the side of the shell facing the human ear is connected with an ear pad, the earphone is provided with an air release hole on the earphone shell between the earphone rear cavity and the earphone sound chamber cavity, and the air release hole is provided with an air release valve which automatically opens due to the increase of pressure. Therefore, when the people wear the earphone or transmit the earphone, the instantaneous pressure wave produced in the sound chamber cavity can be discharged from the air release valve. As for the earphone of the utility model, the vibrating diaphragm is less affected by the airflow interference such that the earphone is characterized by higher sound purity and better hearing experience
(Continued)

compared with those earphones only having the air release hole rather than the valve.

9 Claims, 11 Drawing Sheets

(51) Int. Cl.
*H04R 1/02* (2006.01)
*H04R 31/00* (2006.01)
*H04R 1/10* (2006.01)

(58) Field of Classification Search
USPC ..... 381/370–374
See application file for complete search history.

EARPHONES WITH AIR RELEASE VALVES

FIELD OF THE INVENTION

The utility model relates to sound equipment, specifically to a headphones.

BACKGROUND OF THE INVENTION

Along with daily improvement of people's living standards, people pay more attention to recreational activities after work, in which listening to music is a favorite way to relax of people (including the author).

The earphone is another main music listening device in addition to the sound equipment, the earphone can be divided into moving iron, moving coil and static types according to the working principle. Wherein, the moving iron type is often used in the canal earphone; the static type earphone is difficult to populate due to the higher price and the adoption of the special drive, although the HIFI index thereof is better; and the moving coil type earphone is lower in price and easy to drive, so most of existing headphones (ear-pressing type or ear-covering type) use the moving coil type, the working principle of the moving coil type earphone is connecting the coil in the permanent magnetic field with the vibrating diaphragm and driving the coil under the signal current to drive the vibrating diaphragm to sound.

To obtain the better sound quality of the earphone, the earphone manufacturers generally control the thickness of the vibrating diaphragm to be thinner (SONY corporation of Japan uses the biological diaphragm only having the thickness of 20 microns on MDR-R10 moving coil type earphone in 1988, people can further reduce the thickness of the vibrating diaphragm to obtain better hearing sense along with the improvement of the modern industrial process). However, a problem comes up: the fragile vibrating diaphragm will be impacted by the pressure shock wave produced when people wearing the earphone to be deformed or permanently damaged, the ear pad portions on the worn earphone will press the ear outline of the user and form a closed space in the ear pads, the pressure in the space is increased instantaneously to produce the shock wave. Similarly, the collision during transportation is also easy to produce the pressure shock wave damaging the vibrating diaphragm.

Contents of Utility Model

The technical issue to be solved by the utility model is: providing a headphone of which the vibrating diaphragm is not easy to impact and damage during wiring or transportation.

The technical solution for solving the technical issue provided in the utility model is: an earphone with air release valve comprises a shell, wherein the shell is provided with an earphone rear cavity for accommodating a sounding unit, the sounding unit is placed in the earphone rear cavity and fixedly connected with the shell, the side of the shell facing the human ear is connected with an ear pad; the sounding unit is provided with a vibrating diaphragm, the vibrating diaphragm is combined with the ear pads to form a sound chamber cavity for the sound wave propagation, an air release hole is opened on the shell spacing the earphone rear cavity from the sound chamber cavity, the air release hole is provided with an air release valve which is mainly formed of an air release tube internally having the air release passage and a sealing mechanism arranged in the air release passage, the air release passage are interconnected with the air release through hole.

Furthermore, there are at least two air release through holes and two air release valves, each air release through hole is correspondingly provided with the air release valve, at least one of said at least two air release valves is opposite to the other air release valves in mounting direction.

Furthermore, the sealing mechanism is a hemispherical-shaped silicone diaphragm which is opened at one end and closed at the other end and has the elastic resilience, the air release passage is cylindrical, a mounting sleeve is built in the air release passage via a support wall, the diameter of the opened end of the silicone diaphragm is matched with the inner diameter of the air release passage to form the air-tight seal, the centre of the silicone diaphragm is connected with the mounting handle, the mounting handle is inserted and fastened into the mounting sleeve.

Furthermore, the mounting handle is connected to the centre point at the closed end of the silicone diaphragm, a ring of flange is arranged at the centre of the mounting handle, when the mounting handle is inserted into the mounting sleeve, the flange is clamped on the edge of the rear end of the mounting sleeve, and the closed end of the silicone diaphragm is close to the end surface at one end of the support wall.

Furthermore, the air release passage is provided with a vertical section, the sealing mechanism is a seal ball that can free move in the vertical section, an outlet is opened at the bottom of the vertical section, the aperture of the inlet and outlet of the air release passage is less than that of the seal ball respectively; when the user wears the earphone, the vertical section is vertical, and the seal ball falls into the outlet and seals the outlet under the gravity.

Furthermore, the air release tube is L shaped, the inlet and the outlet are respectively arranged at two ends of the L shape, a seal ball mounting hole through which the seal ball passes in and out is further opened on the air release tube, there is a seal cover on the seal ball mounting hole, the seal cover and the air release tube form a threaded connection therebetween.

Furthermore, the air release tube is a tee, the air release passage includes intercommunicating air inlet passage, first air outlet passage and second air outlet passage in the tee; an inlet, the first outlet and the second outlet are respectively opened on the air inlet passage, the first air outlet passage and the second air outlet passage, the air inlet passage is connected with the air release through hole; the sealing mechanism includes a seal ball that is placed in the first air outlet passage and can free move and a silicone diaphragm placed in the second air outlet passage, the diameter of the outlet, first outlet and second outlet is less than that of the seal ball respectively, the silicone diaphragm is a hemispherical shape which is opened at one end and closed at the other end and has the elastic resilience, the diameter of the opened end of the silicone diaphragm is matched with the inner diameter of the second air outlet passage to form the air-tight seal, the second air outlet passage is cylindrical, a mounting sleeve is built in the second air outlet passage via a support wall, the centre of the silicone diaphragm is connected with the mounting handle, the mounting handle is inserted and fastened into the mounting sleeve; when the earphone is in a vertical state, the first air outlet passage is also in a vertical state, the seal ball falls into the first outlet and seals the first outlet under the gravity.

Furthermore, the mounting handle is connected to the centre point at the closed end of the silicone diaphragm, a ring of flange is arranged at the centre of the mounting handle, the end surface at one end of the support wall facing the silicone diaphragm is an arched shape matched with the closed end of the silicone diaphragm in degree of curve; when the mounting handle is inserted into the mounting sleeve, the flange is clamped on the edge of the rear end of the mounting sleeve, and the closed end of the silicone diaphragm is close to the end surface at one end of the support wall.

The advantages of the utility model are:

The earphone is provided with an air release hole on the earphone shell between the earphone rear cavity and the earphone sound chamber cavity, and the air release hole is provided with an air release valve which automatically opens and releases air due to the increase of pressure. Therefore, when the people wear the earphone or transmit the earphone, the instantaneous pressure wave produced in the sound chamber cavity can be discharged from the air release valve. As for the earphone of the utility model, the vibrating diaphragm is less affected by the airflow interference such that the earphone is characterized by higher sound purity and better hearing experience relative to those earphones only having the air release hole rather than the valve.

BRIEF INTRODUCTION OF THE DRAWINGS in combination with the drawings, the earphone with air release valve of the utility model is further described as follows.

DETAILED DESCRIPTION OF THE PREFERRED EMBODIMENTS

Embodiment 1

Figure 1:
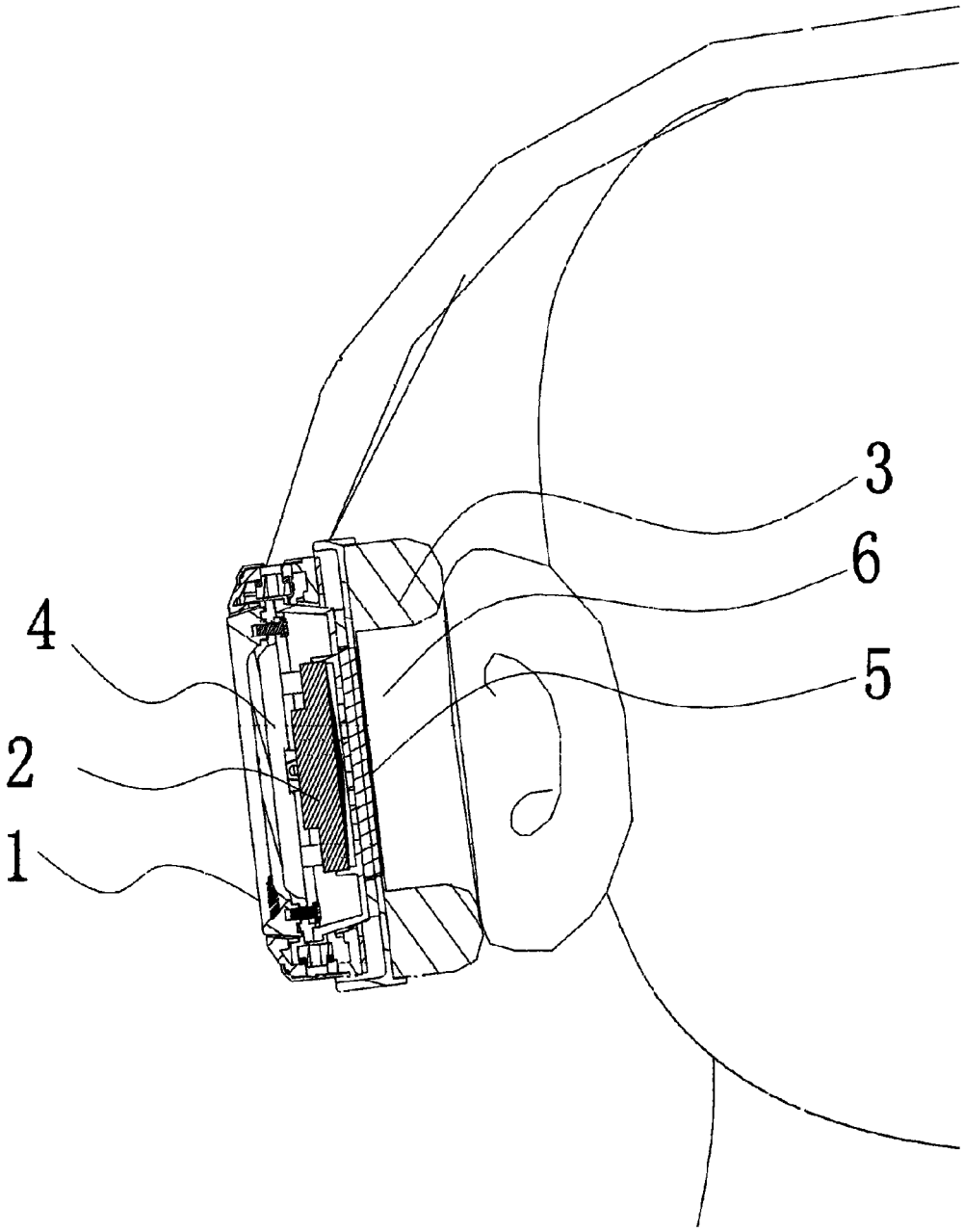
FIG. 1 is the structural and wearing schematic views of the earphone.
Figure 2:
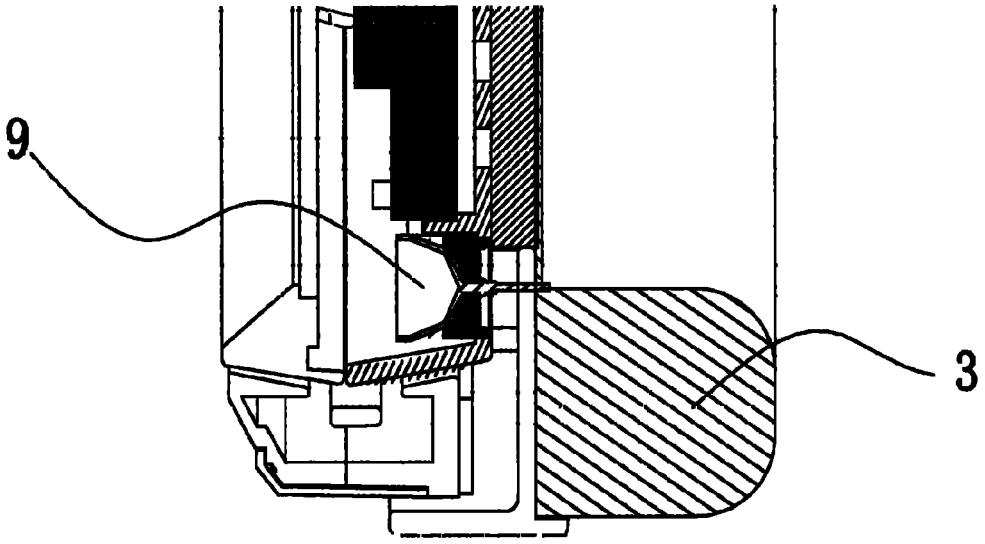
FIG. 2 is the partial structural schematic view of the earphone with air release valve in embodiment 1.
Figure 3:
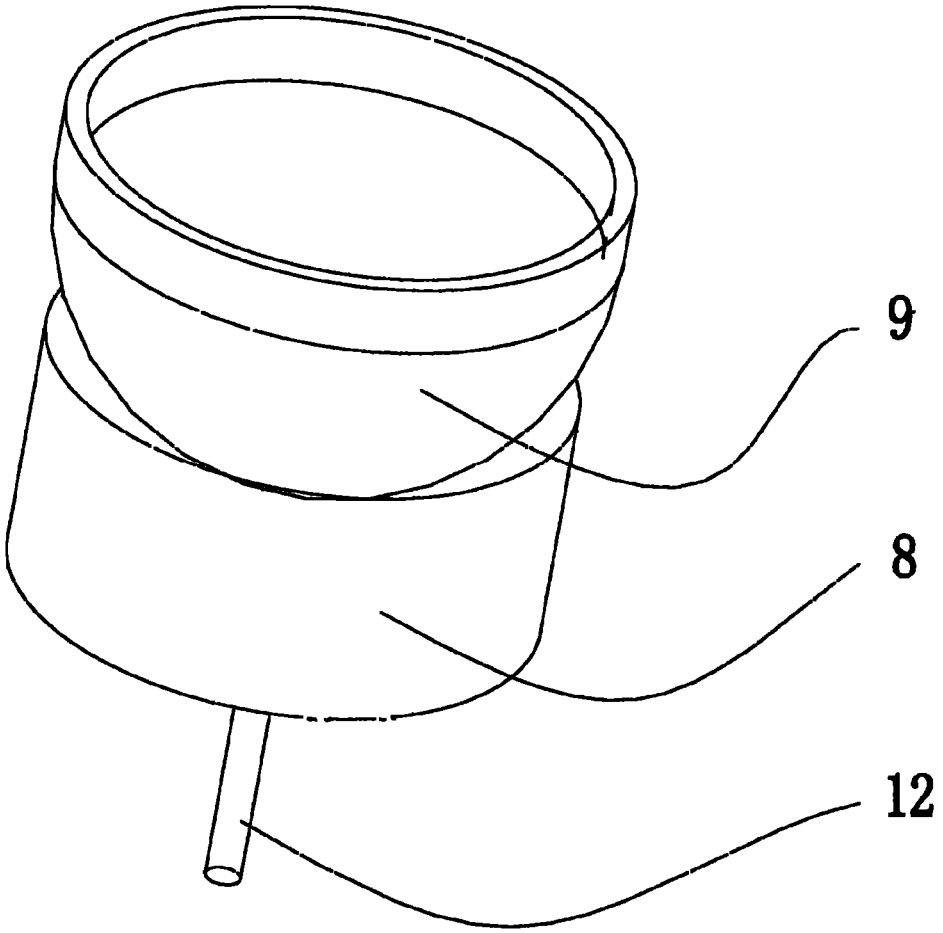
FIG. 3 is the schematic view of the air release valve in embodiment 1.
Figure 4:
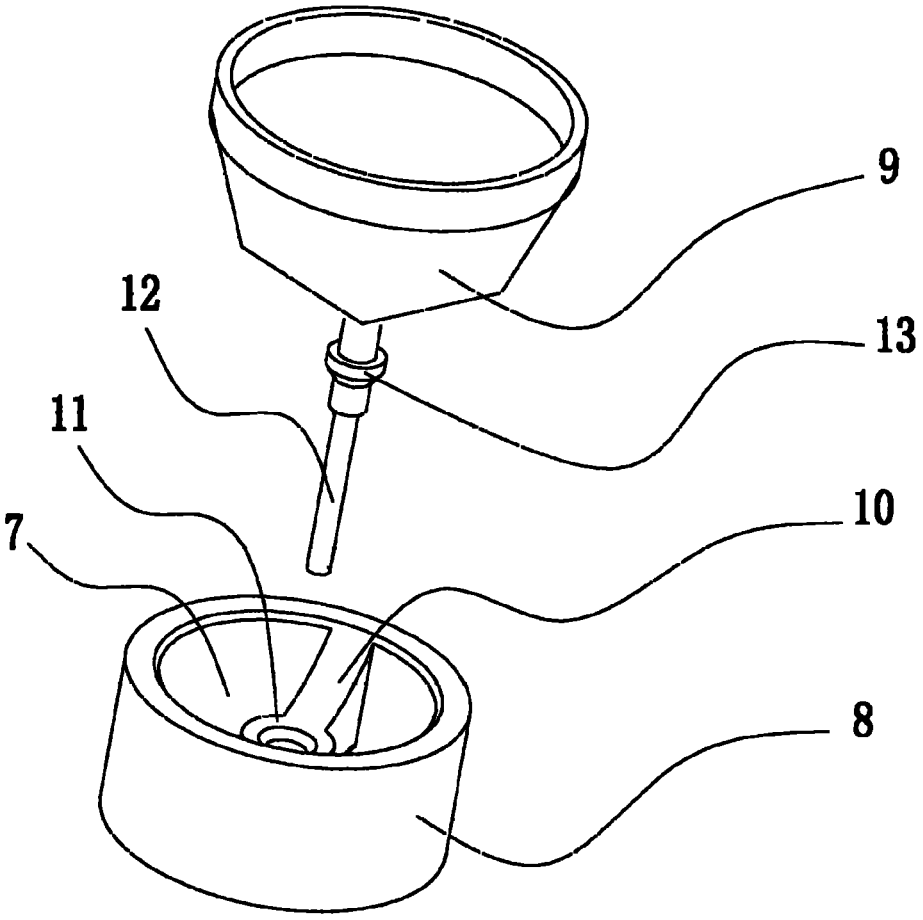
FIG. 4 is the structural exploded view of the air release valve in embodiment 1.
Figure 5:
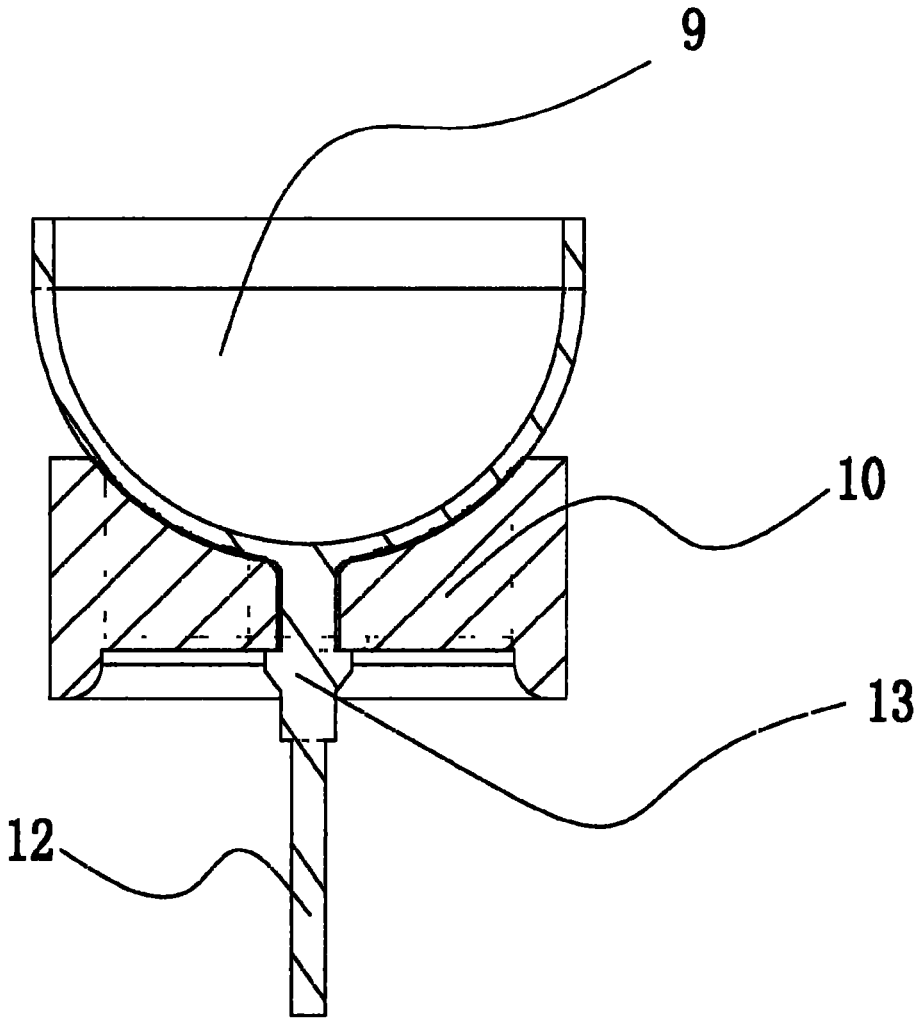
FIG. 5 is the structural cross section view of the air release valve in embodiment 1.

As shown in FIG. 1, FIG. 2, FIG. 3, FIG. 4 and FIG. 5, the earphone with the air release valve in the embodiment comprises a shell 1, a sounding unit 2, an ear pad 3 and an air release valve.

Wherein, the shell is provided with an earphone rear cavity 4 for accommodating a sounding unit 2, the earphone rear cavity 4 is surround by the shell 1, the shell 1 is made of the engineering plastic or wood or metal.

The sounding unit 2 is provided with a vibrating diaphragm 5, the shell 1 at the opening of the earphone rear cavity 4 is provided with a mounting seat for mounting sounding unit 2. The sounding unit 2 is placed in the earphone rear cavity 4 and fixedly connected with the shell 1 via the screw or in an equivalent connection way, adhesion or locking, for example.

The side of the shell 1 facing the human ear is connected with an ear pad 3, the vibrating diaphragm 5 of the sounding unit is combined with the ear pad 3 to form a sound chamber cavity 6 for the sound wave propagation, an air release through hole is opened on the shell 1 spacing the earphone rear cavity 4 from the sound chamber cavity 6, i.e. the air release through hole is opened on the mounting seat.

The air release hole is provided with an air release valve which is mainly formed of an air release tube 8 internally having the air release passage 7 and a hemispherical-shaped silicone diaphragm 9 which is opened at one end and closed at the other end and has the elastic resilience. In the embodiment, the air release tube 8 is cylindrical; the air release passage 7 is intercommunicating with the air leakage through hole. The diameter of the opened end of the silicone diaphragm 9 is matched with the inner diameter of the air release passage 7 to form the air-tight seal, the air release passage 7 is cylindrical, a mounting sleeve 11 is built in the air release passage 7 via a support wall 10, the centre of the closed end of the silicone diaphragm 9 is connected with the mounting handle 12, the mounting handle 12 is inserted and fastened into the mounting sleeve 11. A ring of flange 13 is arranged at the centre of the mounting handle, the end surface of the side of the support wall 11 facing the silicone diaphragm 9 is made into an arched shape matched with the closed end of the silicone diaphragm 9 in degree of curve; when the mounting handle 12 is inserted into the mounting sleeve 11, the flange is clamped on the edge of the rear end of the mounting sleeve 11, and the closed end of the silicone diaphragm 9 is close to the end surface at one end of the support wall 10.

In use, the pressure shock wave produced by user wearing the headphone enters into the air release passage 7 through the air release through hole and impacts and further deforms the silicone diaphragm 9 in the air release passage 7, the air-tight seal between the deformed silicone diaphragm 9 and the air release passage 7 is broken, the pressure shock wave is discharged from the slit between the silicone diaphragm 9 and the air release passage 7; after the pressure between the earphone rear cavity 4 and the sound chamber cavity 6 is balanced, the silicone diaphragm 9 restores the original form upon the elastic resilience and forms the air-tight seal to the air release passage 7 again to stop the airflow in the earphone rear cavity 4 from entering into the sound chamber cavity 6 and interfering the sound propagation.

Obviously, the silicone diaphragm 9 may be a flat or corrugated shape rather than a hemispherical shape, as long as the elastic resilience performance is provided at the same time.

Embodiment 2

To further protect the vibrating diaphragm and prevent the vibrating diaphragm 5 from the negative pressure impact during headphone taking-off or in other situations, the embodiment makes a further improvement based on embodiment 1: there are two air release through holes and two air release valves, each air release through hole is correspondingly provided with the air release valve, one of the air release valve is opposite to the other air release valve in mounting direction.

Similarly, conceivably, there are three air release through holes and three air release valves each air release through hole is correspondingly provided with the air release valve, one of the air release valve is opposite to the other two air release valve in mounting direction. In the same way, there are four or five air release through holes and air release valves respectively etc.

Embodiment 3

Figure 6:
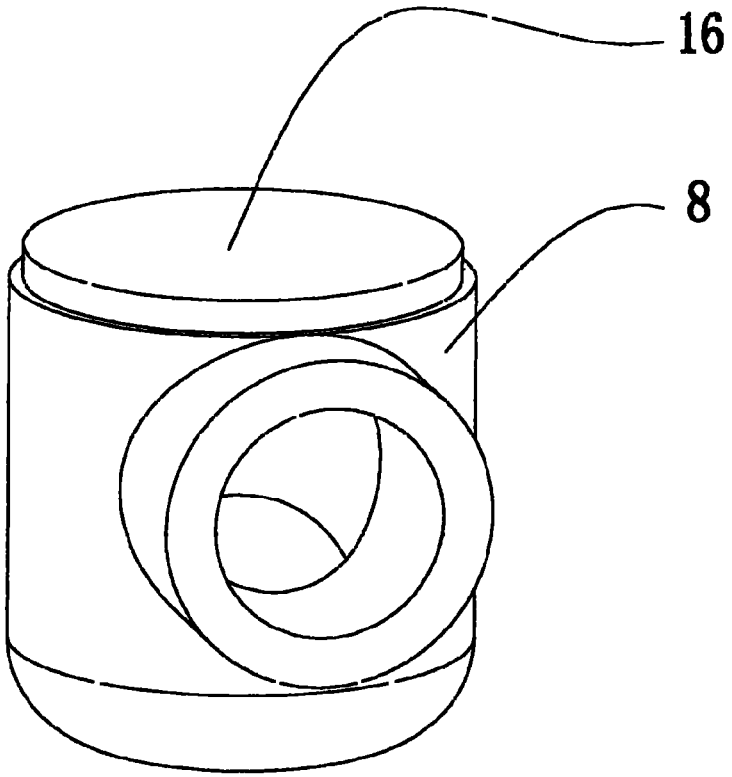
FIG. 6 is the schematic view of the release valve in embodiment 3.
Figure 7:
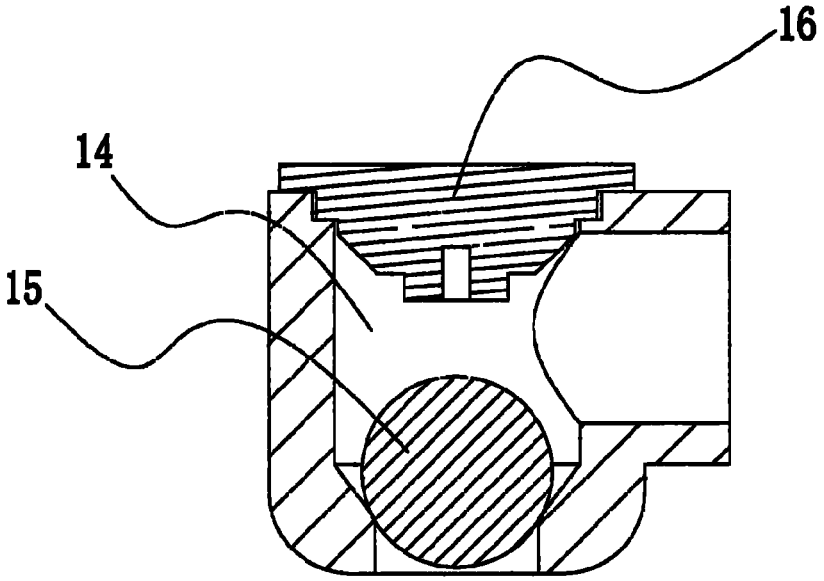
FIG. 7 is the structural cross section view of the air release valve in embodiment 3.
Figure 8:
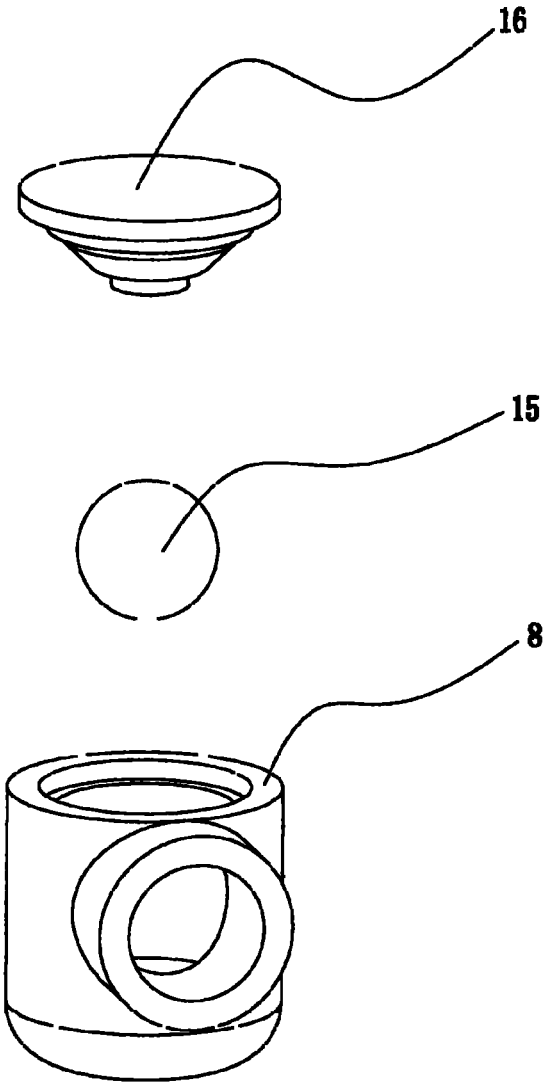
FIG. 8 is the structural exploded view of the air release valve in embodiment 3.
Figure 9:
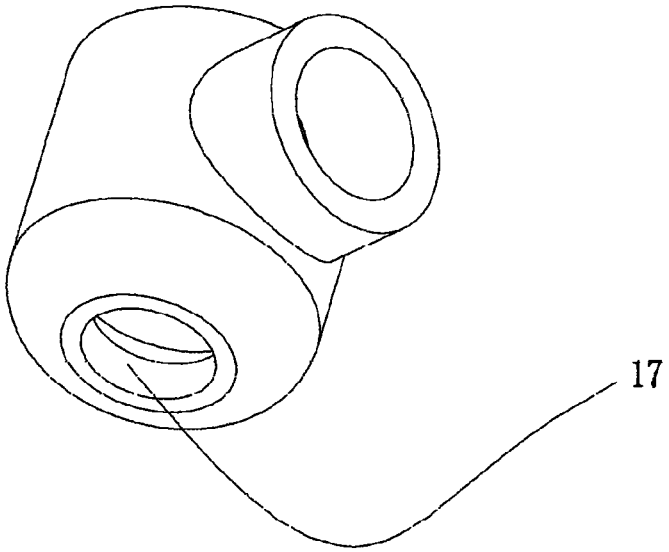
FIG. 9 is the bottom structural schematic view of the air release valve in embodiment 3.

The technical solution in the embodiment is a replacement of embodiment 1, which differs embodiment 1 in the air release valve: as shown in FIG. 6, FIG. 7, FIG. 8 and FIG. 9, the air release valve is mainly formed of an air release tube 8 internally having the air release passage and a seal ball, the air release tube 8 is L shaped, the outlet 17 and the inlet are respectively arranged at two ends of the L shape, the seal ball 15 is made of stainless steel, or of the other material with the same mass, such as plastic, copper. The air release passage includes a vertical section 14 which is cylindrical; the diameter of the vertical section 14 is greater than that of the seal ball 15, the seal ball 15 free moves in the vertical section 14, the outlet 17 is arranged at the bottom of the vertical section 14, the aperture of the inlet and outlet 17 are respectively smaller than that of the seal ball 15; when the user worn the earphone, the vertical section is vertical, the seal ball 15 falls into the outlet 17 and seals the outlet 17 under the gravity.

The purpose of providing the seal ball 15 is: the earphone is not in the vertical state during transportation basically, the seal ball 15 does not seal the outlet 17 at the moment such that the pressure shock wave produced by the collision of the earphone can be timely discharged through the outlet 17 to avoid any damage of the vibrating diaphragm 5.

For manufacturing convenience, a seal ball 15 mounting hole through which the seal ball 15 passes in and out is opened on the air release tube 8, the seal ball 15 mounting hole is provided with a seal cover 16, and the seal cover 16 and the air release tube 8 form a threaded connection therebetween.

Embodiment 4

Figure 10:
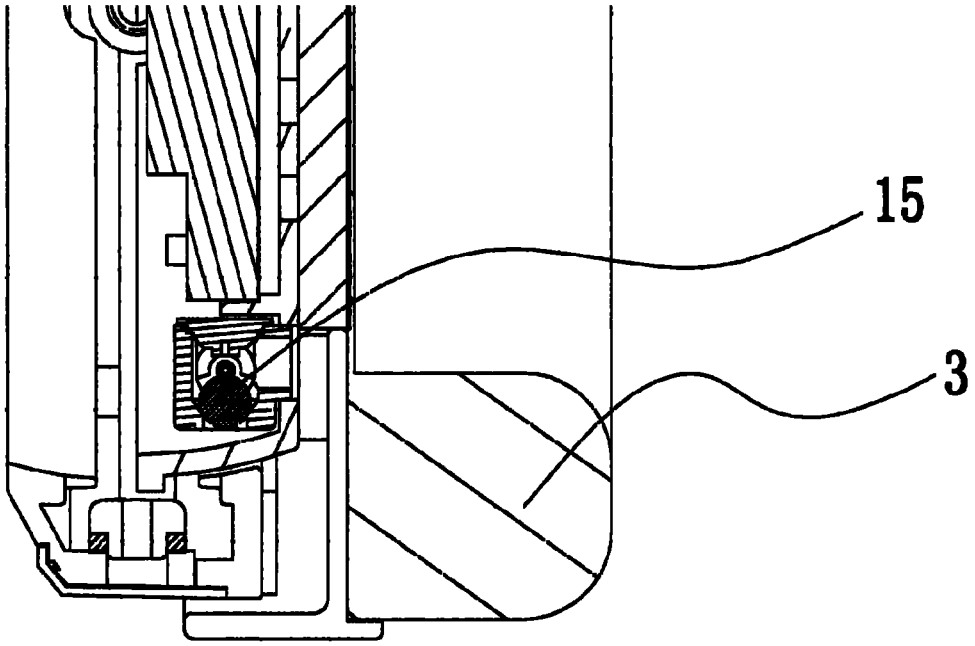
FIG. 10 is the partial structural schematic view of the earphone in embodiment 4.
Figure 11:
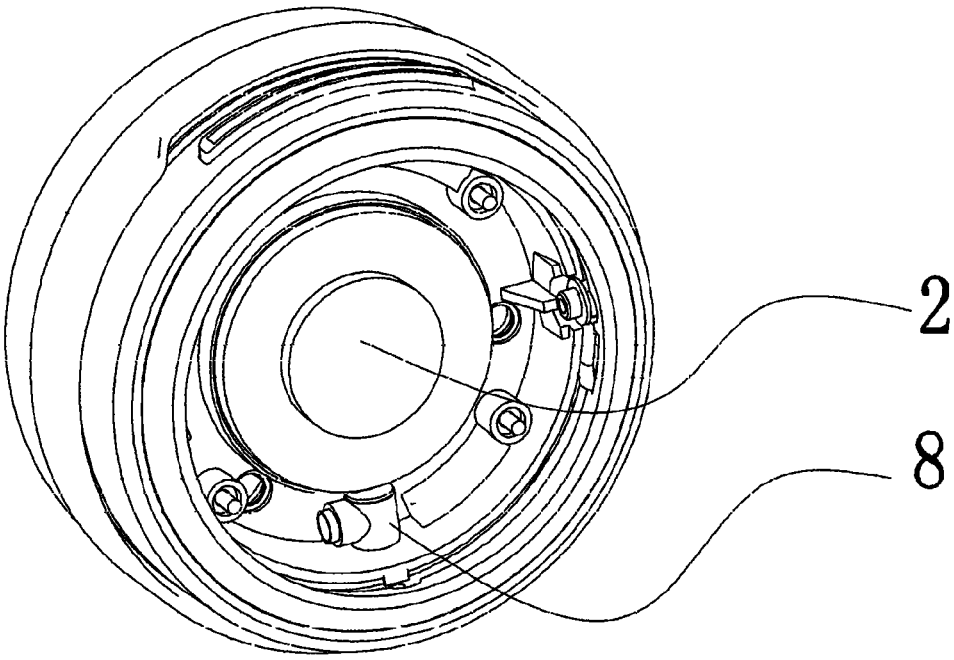
FIG. 11 is the structural cross section view of the earphone assembled with the air release valve in embodiment 4.
Figure 12:
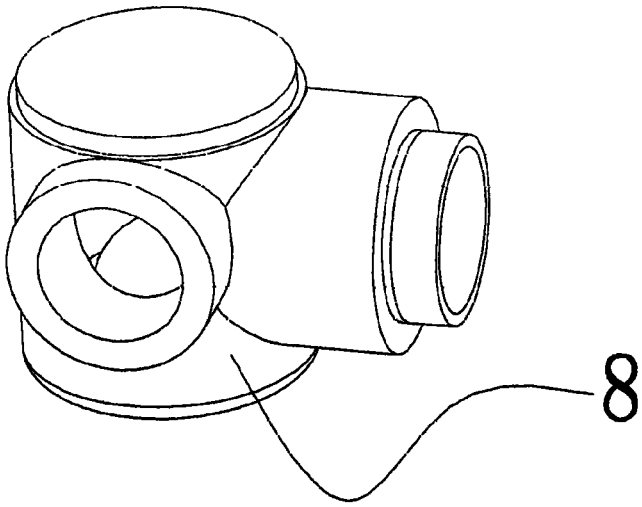
FIG. 12 is the structural schematic view of the air release valve in embodiment 4.
Figure 13:
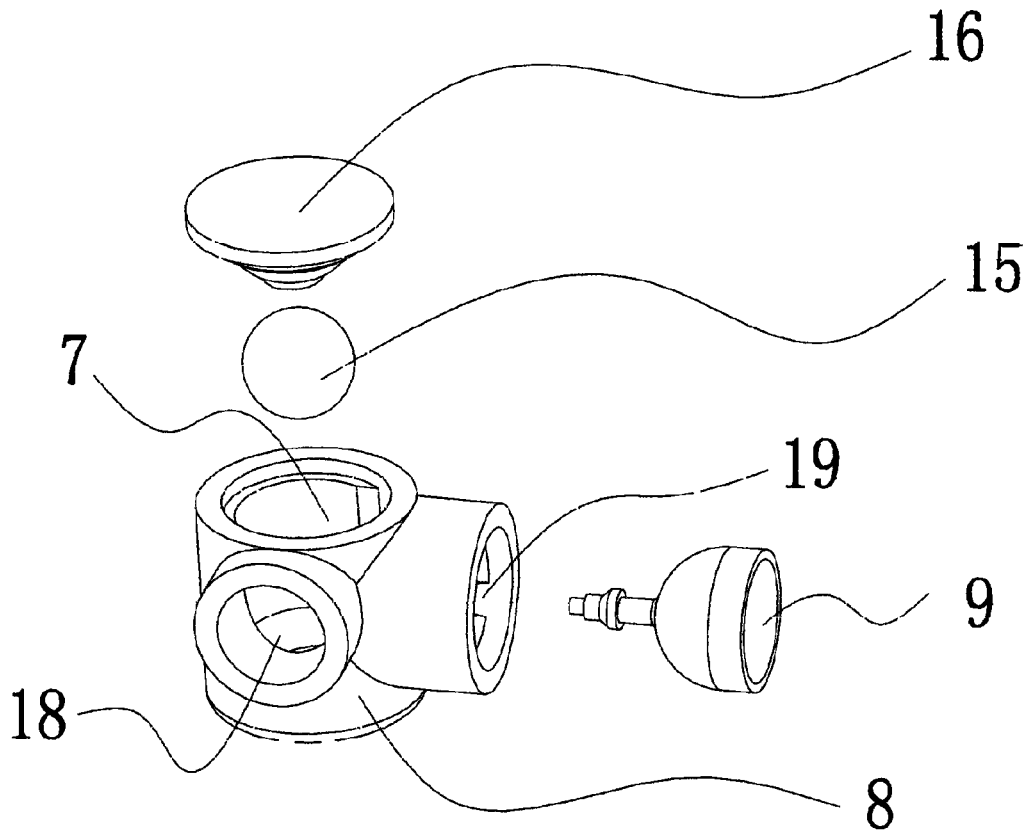
FIG. 13 is the structural exploded view of the air release valve in embodiment 4.
Figure 14:
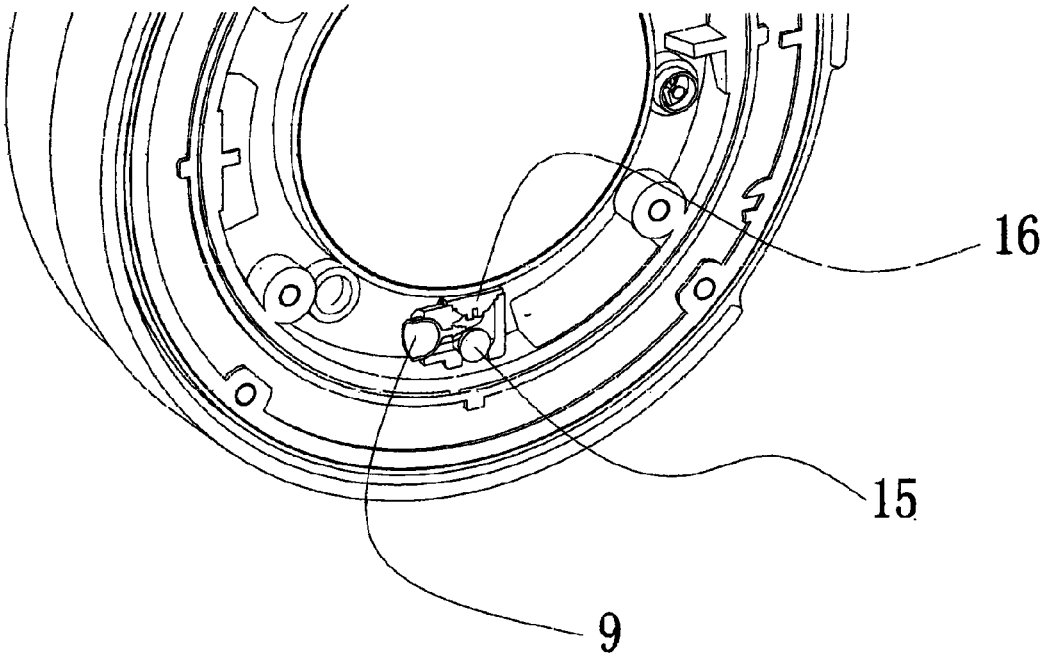
FIG. 14 is the sectional structural exploded view of the air release valve mounted on the earphone in embodiment 4.

The embodiment is a further improvement based on embodiment 1 and embodiment 3, the difference is: as shown in FIG. 10, FIG. 11, FIG. 12, FIG. 13 and FIG. 14, the air released valve in the embodiment mainly consists of an air release tube 8, a seal ball 15 and a silicone diaphragm 9.

The air release tube 8 is a tee, the air release passage 7 includes intercommunicating air inlet passage, first air outlet passage and second air outlet passage in the tee; an inlet 18, the first outlet (not shown) and the second outlet 19 are respectively opened on the air inlet passage, the first air outlet passage and the second air outlet passage, and the air inlet passage is connected with the air leakage through hole.

The seal ball 15 is placed in the first air outlet passage and moves free therein, the diameter of the inlet 18, first outlet and second outlet 19 is respectively less than that of the seal ball 15. When the earphone is in a vertical state, the first air outlet passage is also in a vertical state, the seal ball 15 falls into the first outlet and seals the first outlet under the gravity. A seal ball 15 mounting hole through which the seal ball 15 passes in and out is further opened on the air release tube 8, the seal ball 15 mounting hole is provided with a seal cover 16, and the seal cover and the air release tube form a threaded connection therebetween.

The silicone diaphragm 9 is arranged in the second air outlet passage, the silicone diaphragm 9 is a hemispherical shaped which is opened at one end and closed at the other end and has the elastic resilience. The diameter at one end of the silicone diaphragm 9 is matched with the inner diameter of the second air outlet passage to form the air-tight seal, the second air outlet passage is cylindrical, a mounting sleeve is built in the second air outlet passage via a support wall, the mounting handle is connected to the centre point at the closed end of the silicone diaphragm 9, the centre of the silicone diaphragm 9 is connected with the centre, a ring of flange is arranged in the middle of the mounting handle, the end surface at one side of the support wall facing the silicone diaphragm 9 is made into an arched shape matched with the closed end of the silicone diaphragm 9 in degree of curve; when the mounting handle is inserted in the mounting sleeve, the flange is locked on the edge of the rear end of the mounting sleeve, the closed end of the silicone diaphragm 9 is close to the end surface at one end of the support wall.

Obviously, silicone diaphragm 9 may be a flat or corrugated shape rather than a hemispherical shape, as long as the elastic resilience performance is provided at the same time.

The headphone in the embodiment combines the advantages of embodiments 1 and 3; during transportation of the earphone, the seal ball 15 keeps the conduction of the air release passage 7; the ventilation is achieved by deformation of the silicone diaphragm 9 when headphone is worn.

The utility model is not limited to the embodiments mentioned above, any technical solution using the equivalent replacement is to be embraced within the scope of protection of the utility model.

The invention claimed is:

1. An earphone with an air release valve, comprising:

a shell, wherein the shell is provided with an earphone rear cavity for accommodating a sounding unit, the sounding unit being provided in the earphone rear cavity and fixedly connected with the shell, and the side of the shell facing the human ear being connected with an ear pad, the sounding unit being provided with a vibrating diaphragm, the vibrating diaphragm being combined with the ear pad to form a sound chamber cavity for the sound wave propagation;

an air release hole opened on the shell spacing the earphone rear cavity from the sound chamber cavity, the air release hole being provided with an air release value which is mainly formed of an air release tube internally having an air release passage and a sealing mechanism arranged in the air release passage, the air release passage being interconnected with the air release through hole, wherein the sealing mechanism is a hemispherical-shaped silicone diaphragm which is opened at one end and closed at the other end and has the elastic resilience, the air release passage is cylindrical, a mounting sleeve is built in the air release passage via a support wall, the diameter of the opened end of the silicone diaphragm is matched with the inner diameter of the air release passage to form the air-tight seal, the center of the silicone diaphragm is connected with the mounting handle, and the mounting handle is inserted and fastened into the mounting sleeve.

2. The earphone with the air release valve as claimed in claim 1, wherein there are at least two air release through holes and two air release valves, each air release through hole is correspondingly provided with the air release valve, at least one of said at least two air release valves is opposite to the other air release valves in mounting direction.

3. The earphone with the air release valve as claimed in claim 1, wherein the mounting handle is connected to the center point at the closed end of the silicone diaphragm, a ring of flange is arranged at the center of the mounting handle, when the mounting handle is inserted into the mounting sleeve, the flange is clamped on the edge of the rear end of the mounting sleeve, and the closed end of the silicone diaphragm is close to the end surface at one end of the support wall.

4. An earphone with an air release valve, comprising:

a shell, wherein the shell is provided with an earphone rear cavity for accommodating a sounding unit, the sounding unit being provided in the earphone rear cavity and fixedly connected with the shell, and the side of the shell facing the human ear being connected with an ear pad, the sounding unit being provided with a vibrating diaphragm, the vibrating diaphragm being combined with the ear pad to form a sound chamber cavity for the sound wave propagation;

an air release hole opened on the shell spacing the earphone rear cavity from the sound chamber cavity, the air release hole being provided with an air release value which is mainly formed of an air release tube internally having an air release passage and a sealing mechanism arranged in the air release passage, the air release passage being interconnected with the air release through hole, wherein the air release passage is provided with a vertical section, the sealing mechanism is a seal ball that can free move in the vertical section, an outlet is opened at the bottom of the vertical section, and the aperture of the inlet and outlet of the air release passage is less than that of the seal ball respectively;

wherein, when the user wears the earphone, the vertical section is vertical, and the seal ball falls into the outlet and seals the outlet under the gravity.

5. The earphone with the air release valve as claimed in claim 4, wherein the air release tube is L shaped, the inlet and the outlet are respectively arranged at two ends of the L shape, a seal ball mounting hole through which the seal ball passes in and out is further opened on the air release tube, there is a seal cover on the seal ball mounting hole, and the seal cover and the air release tube form a threaded connection therebetween.

6. An earphone with the air release valve, comprising:

a shell, wherein the shell is provided with an earphone rear cavity for accommodating a sounding unit, the sounding unit being provided in the earphone rear cavity and fixedly connected with the shell, and the side of the shell facing the human ear being connected with an ear pad, the sounding unit being provided with a vibrating diaphragm, the vibrating diaphragm being combined with the ear pad to form a sound chamber cavity for the sound wave propagation;

an air release hole opened on the shell spacing the earphone rear cavity from the sound chamber cavity, the air release hole being provided with an air release value which is mainly formed of an air release tube internally having an air release passage and a sealing mechanism arranged in the air release passage, the air release passage being interconnected with the air release through hole, wherein the air release tube is a tee, the air release passage includes intercommunicating air inlet passage, first air outlet passage and second air outlet passage in the tee; an inlet, the first outlet and the second outlet are respectively opened on the air inlet passage, the first air outlet passage and the second air outlet passage, the air inlet passage is connected with the air release through hole; the sealing mechanism includes a seal ball that is placed in the first air outlet passage and can free move and a silicone diaphragm placed in the second air outlet passage, the diameter of the outlet, first outlet and second outlet is less than that of the seal ball respectively, the silicone diaphragm is a hemispherical shape which is opened at one end and closed at the other end and has the elastic resilience, the diameter of the opened end of the silicone diaphragm is matched with the inner diameter of the second air outlet passage to form the air-tight seal, the second air outlet passage is cylindrical, a mounting sleeve is built in the second air outlet passage via a support wall, and the center of the silicone diaphragm is connected with the mounting handle, the mounting handle is inserted and fastened into the mounting sleeve;

wherein, when the earphone is in a vertical state, the first air outlet passage is also in a vertical state, the seal ball falls into the first outlet and plugs the first outlet under the gravity.

7. The earphone with the air release valve as claimed in claim 6, wherein the mounting handle is connected to the center point at the closed end of the silicone diaphragm, a ring of flange is arranged at the center of the mounting handle, the end surface at one end of the support wall facing the silicone diaphragm is an arched shape matched with the closed end of the silicone diaphragm in degree of curve; when the mounting handle is inserted into the mounting sleeve, the flange is clamped on the edge of the rear end of the mounting sleeve, and the closed end of the silicone diaphragm is close to the end surface at one end of the support wall.

8. The earphone with the air release valve as claimed in claim 6, wherein there are at least two air release through holes and two air release valves, each air release through hole is correspondingly provided with the air release valve, at least one of said at least two air release valves is opposite to the other air release valves in mounting direction.

9. The earphone with the air release valve as claimed in claim 4, wherein there are at least two air release through holes and two air release valves, each air release through hole is correspondingly provided with the air release valve, at least one of said at least two air release valves is opposite to the other air release valves in mounting direction.

* * * * *